US009743710B2

(12) United States Patent
Madelaine et al.

(10) Patent No.: US 9,743,710 B2
(45) Date of Patent: Aug. 29, 2017

(54) FOOTWEAR WITH IMPROVED UPPER

(75) Inventors: Delphine Madelaine, Annecy (FR); Rémi Drevetton, Poisy (FR)

(73) Assignee: SALOMON S.A.S., Metz-Tessy (FR)

( * ) Notice: Subject to any disclaimer, the term of this patent is extended or adjusted under 35 U.S.C. 154(b) by 1273 days.

(21) Appl. No.: 13/114,504

(22) Filed: May 24, 2011

(65) Prior Publication Data

US 2011/0289797 A1 Dec. 1, 2011

(30) Foreign Application Priority Data

May 25, 2010 (FR) ..... 10 02173

(51) Int. Cl.

| | |
|---|---|
| ***A43B 9/02*** | (2006.01) |
| ***A43B 3/10*** | (2006.01) |
| ***A43B 3/12*** | (2006.01) |
| ***A43B 19/00*** | (2006.01) |
| ***A43B 23/04*** | (2006.01) |

(52) U.S. Cl.

CPC ..... *A43B 9/02* (2013.01); *A43B 3/103* (2013.01); *A43B 3/122* (2013.01); *A43B 19/00* (2013.01); *A43B 23/042* (2013.01)

(58) Field of Classification Search

USPC ..... 36/88, 45, 47, 48, 9 R

See application file for complete search history.

(56) References Cited

U.S. PATENT DOCUMENTS

| | | | | | |
|---|---|---|---|---|---|
| 18,938 | A | * | 12/1857 | Hamilton | 74/44 |
| 126,450 | A | * | 5/1872 | Drown | 36/9 R |
| 2,384,927 | A | * | 9/1945 | Julianelli | 36/11 |
| 3,762,075 | A | * | 10/1973 | Munschy | 36/97 |
| 4,176,475 | A | * | 12/1979 | Arcamonte | 36/9 R |
| 5,345,638 | A | * | 9/1994 | Nishida | 12/146 C |
| 5,604,997 | A | * | 2/1997 | Dieter | 36/45 |
| 2004/0205982 | A1 | | 10/2004 | Challe | |

FOREIGN PATENT DOCUMENTS

| | | | |
|---|---|---|---|
| DE | 930 858 | C | 7/1955 |
| DE | 20 2008 005635 | U1 | 7/2008 |
| FR | 338 659 | A | 6/1904 |
| FR | 761 540 | A | 3/1934 |
| FR | 1 099 005 | A | 8/1955 |
| FR | 1 412 817 | A | 10/1965 |
| FR | 2 507 873 | A1 | 12/1982 |

* cited by examiner

*Primary Examiner* — Megan Brandon

(74) *Attorney, Agent, or Firm* — Greenblum & Bernstein, P.L.C.

(57) ABSTRACT

An article of footwear including an inner sole assembly and an upper, the article of footwear extending lengthwise from a rear end to a front end, widthwise from a lateral side and a medial side, and heightwise from the outer sole assembly to a top portion. The article of footwear includes a first footwear element which includes an inner sole assembly, a lateral quarter, and a medial quarter. The inner sole assembly, the lateral quarter, and the medial quarter of the first footwear element form a unitary element.

18 Claims, 9 Drawing Sheets

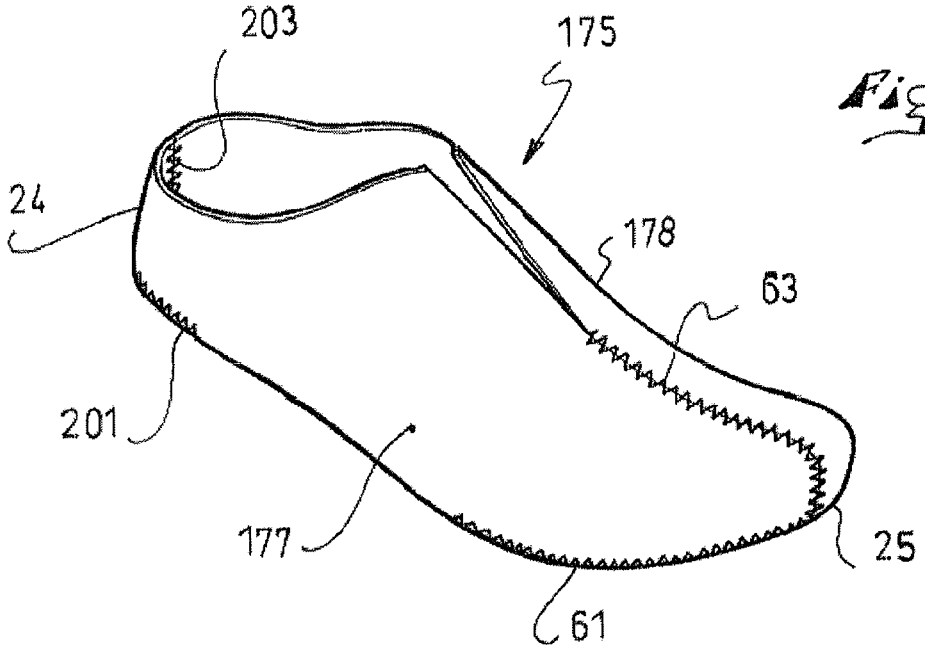
Fig: 10
Fig: 11
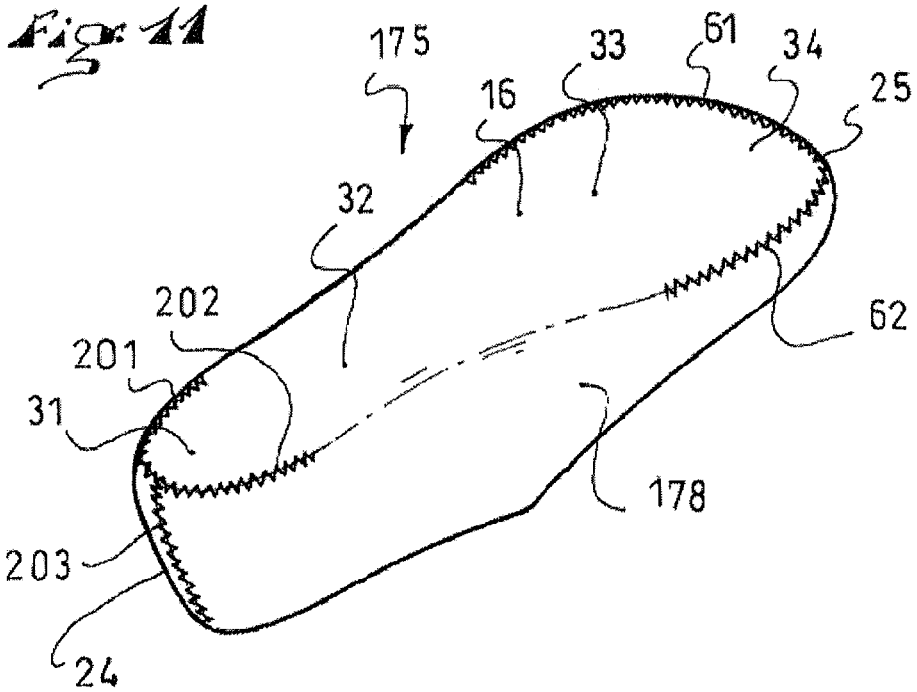

FOOTWEAR WITH IMPROVED UPPER

CROSS-REFERENCE TO RELATED APPLICATION

This application is based upon the French Patent Application No. 10.02173, filed May 25, 2010, the disclosure of which is hereby incorporated by reference thereto, and the priority of which is hereby claimed under 35 U.S.C. §119.

BACKGROUND

1. Field of the Invention

The invention relates to walking or sports footwear, whether referred to as shoes or boots, more particularly footwear intended for traversing flat or mountainous terrain, for use with a skateboard, a snowboard, skis or snowshoes, or for practicing a ball-playing sport, for example, as well as for other uses and activities.

2. Background Information

To make footwear adapted to the aforementioned practices and activities, it is known to use an outer sole assembly and a footwear element. Such element itself includes an envelope, which is part of the boot upper, and an inner sole, which may be a lasting board or a Strobel lasting board, depending upon the technique employed. A lasting board is affixed to the envelope by gluing, whereas a Strobel lasting board is affixed to the envelope by stitching. In any case, the footwear element thus obtained is affixed to the outer sole assembly by any suitable means, such as by gluing, nesting, or the like.

To provide the footwear with a satisfactory level of comfort, an insole is positioned within the footwear element, so as to cover the lasting board or Strobel lasting board. The insole also typically covers the junction between the lasting board or Strobel lasting board and the envelope.

Thus, the shoe obtained is satisfactory in most cases, especially in the sense that it provides a certain comfort to the foot. There are, however, several drawbacks.

For example, during extreme or prolonged use, small injuries may occur in the area the user's foot. Indeed, the insole may for example move undesirably inside the footwear element. Also, the contact between the user's foot and the footwear element is sometimes not uniform. Therefore, even when properly provided, comfort is not maximal.

Another drawback of the aforementioned articles of footwear lies in their relative complexity. This complexity is primarily considered in the sense that several different soles are required to form the complete sole assembly, as well as several parts, including quarters, a stiffener, a vamp, or a tongue to form the envelope of the footwear element. In other words, a large number of parts is required to manufacture the such footwear. The complexity can also be considered in the sense that a large set of tools is required to prepare the parts, a large amount of time is required for assembly, and that the nature of the assembly work itself is complex. In addition, such complexity, or complexities, cause production costs to be increased.

SUMMARY

In light of the preceding description, the invention improves upon footwear for walking, for sports, and for other uses and activities, whether in the form of a boot, a shoe, or referenced by some other term. The terms boot and shoe, e.g., are mentioned in this disclosure, although neither term is to be construed as necessarily limiting the invention with respect to the other.

Not only does the invention provide a general improvement for footwear, the invention provides for an improvement in comfort for footwear as well as a reduction in complexity.

In these regards, the invention provides an article of footwear that includes an outer sole assembly and an upper, the article of footwear extending lengthwise from a rear end to a front end, widthwise between a lateral side and a medial side, and heightwise from the outer sole assembly to an upper end, the article of footwear including a first footwear element, the first footwear element including an inner sole assembly, a lateral quarter, and a medial quarter.

Within the scope of the article of footwear of the invention is the feature that the inner sole assembly, the lateral quarter, and medial quarter of the first footwear element form one piece, i.e., a single, unitary part.

The inner sole assembly, the lateral quarter, and the medial quarter are connected to one another, at least partially, via material continuity. Consequently, the footwear element has at least one continuous surface portion, i.e., a single part, that extends, in the area of the inner sole assembly, to both the lateral quarter and to the medial quarter. This surface portion can be within the footwear element, i.e., it is capable of contacting the foot. As a result, the contact between the foot and the footwear element and, therefore, between the foot and the upper, is more uniform than in footwear according to the prior art. For this particular reason, an article of footwear according to the invention is advantageously more comfortable. The continuity of contact optimizes the pressure distribution on the foot.

Moreover, because the inner sole assembly, the lateral quarter, and the medial quarter form a unitary element, the number of constituent parts of the article of footwear is reduced compared to an equivalent article of footwear according to the prior art. Therefore, an article of footwear of the invention requires, for its manufacture, a smaller number of tools, a reduced number of operations, and a reduced assembly time. The assembly work is therefore simpler. Generally speaking, the footwear according to the invention is advantageously simpler than prior art footwear. Therefore, footwear according to the invention is less expensive, and can be inexpensive, to manufacture.

BRIEF DESCRIPTION OF DRAWINGS

Other characteristics and advantages of the invention will be better understood from the description that follows, with reference to the annexed drawings illustrating, by way of non-limiting embodiments, how the invention can be embodied, and in which:

FIG. 10 is a perspective top front view of a footwear element, made from the pattern of FIG. 9;

FIG. 11 is a perspective bottom rear view, on the side of the inner sole assembly, of the footwear element of FIG. 10;

DETAILED DESCRIPTION

The first embodiment relates more particularly to footwear intended for casual walking, such as "around town," for example, or on fairly regular terrain, such as flat terrain. However, the invention applies to other uses and activities, such as those mentioned above.

The first embodiment is described below with reference to FIGS. 1 to 6.

Figure 1:
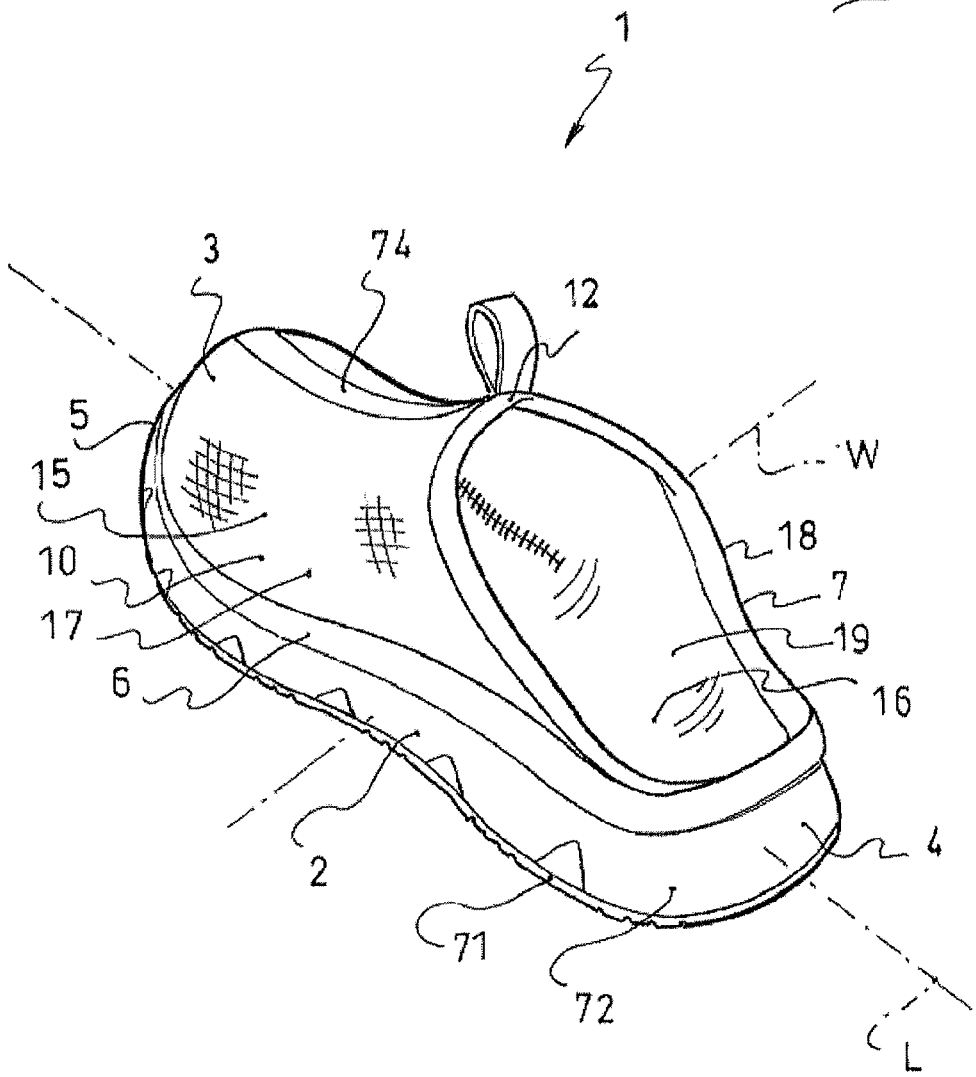
FIG. 1 is a perspective top rear view of a shoe according to a first embodiment of the invention.

As shown in FIG. 1, an article of footwear, in the form of a walking shoe 1, is adapted to receive the foot of a user. Conventionally, the shoe 1 includes an outer sole assembly 2 and an upper 3 arranged on the outer sole assembly. The shoe extends lengthwise along a longitudinal direction L, between a rear end 4, or heel, and a front end 5, or tip, and widthwise along a transverse direction W, between a lateral side 6 and a medial side 7.

As shown, the upper 3 only includes a lower portion 10, provided to surround the foot, excluding any upper portion. However, an upper including a lower portion and an upper portion could alternatively be provided.

According to the first illustrated embodiment, the shoe extends heightwise, from the outer sole assembly 2 to the top 12, i.e., up to the free end of the lower portion 10 or of the upper 3.

The shoe 1 is structured to allow for a good foot rolling movement when walking, transmission of sensory information, as well as impulse forces for supports and landings. Therefore, the outer sole assembly 2 and the upper 3 are flexible, or relatively flexible.

The shoe 1 as illustrated is devoid of a device for tightening the upper 3, such as laces, for example. Indeed, as will be better understood hereinafter, the shoe is shaped to fit the foot closely, like a second skin. Therefore, the upper 3 is continuous from the lateral side 6 to the medial side 7. However, in some cases, the shoe 1 could include a device for tightening the upper 3, without departing from the scope of the invention.

In a non-limiting manner, the shoe 1 includes a single footwear element 15. This means that the element 15 demarcates both the exterior and the interior of the upper 3, the interior corresponding to the volume receiving the foot. As such, the footwear element 15 includes an inner sole assembly 16, a lateral quarter 17, and a medial quarter 18.

According to the invention, the inner sole assembly 16, the lateral quarter 17, and the medial quarter 18 form a unitary element, i.e., a single piece of material, i.e., a unitary piece of material. The inner sole assembly 16, the lateral quarter 17, and the medial quarter 18 are connected to one another, at least partially, by material continuity. Therefore, the footwear element 15 has at least one continuous surface portion 19 that extends at the same time into the area of the inner sole assembly 16, into the area of the lateral quarter 17, and into the area of the medial quarter 18. This makes the shoe 1 more comfortable. The continuous surface portion 19 is located in the area of the arch of the foot.

Figure 2:
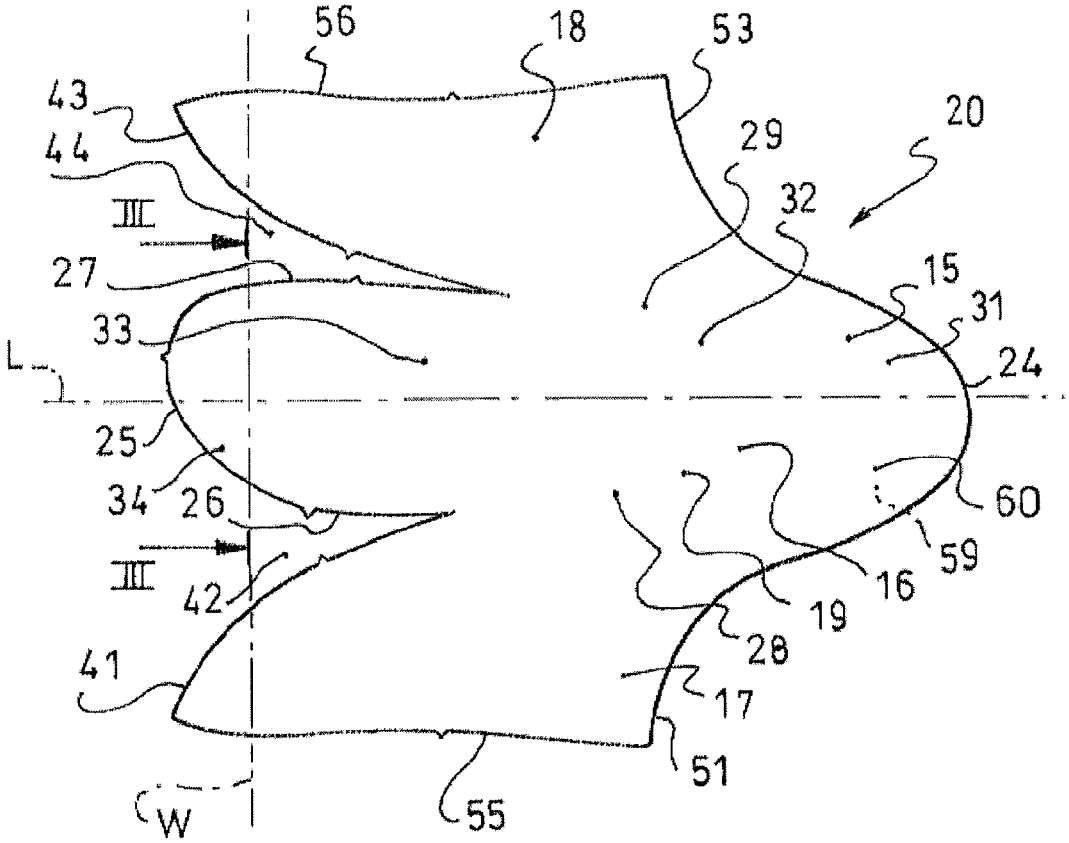
FIG. 2 is a view showing a flat pattern constructed and arranged for the manufacture of a footwear element of the shoe of FIG. 1.
Figure 3:
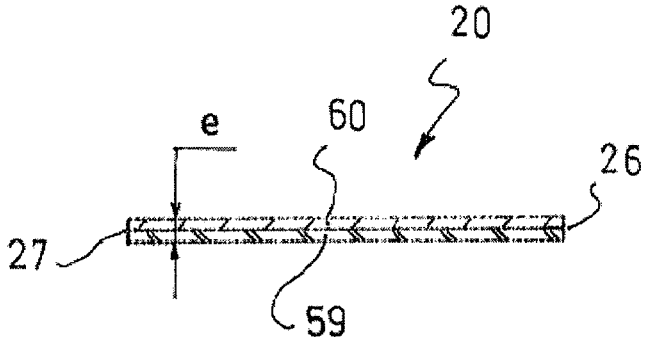
FIG. 3 is a cross section along the line III-III of FIG. 2.

As can be understood with reference to FIGS. 2 and 3, the footwear element 15 is obtained by flat patterning, i.e., in the form of a flat pattern. This means that before the shoe 1 takes its three-dimensional shape, a two-dimensional pattern 20 demarcates the footwear element 15, namely the inner sole assembly 16, the lateral quarter 17, and the medial quarter 18. These three portions 16, 17, 18 are therefore contained in the same plane during an initial manufacturing stage. At this stage, the inner sole assembly 16 is transversely arranged between the lateral quarter 17 and the medial quarter 18. In other words, the inner sole assembly 16 separates the quarters 17, 18 along the transverse direction W of the shoe 1.

The inner sole assembly 16 extends lengthwise along the longitudinal direction L, from a rear end 24 to a front end 25. Each end 24, 25 is convex in order to follow the contours of the heel and the toes, respectively, as further described below. The inner sole assembly 16 extends widthwise along the transverse direction W, between a lateral edge 26 and a medial edge 27 on the side of the front end 25, and between a lateral border 28 and a medial border 29 on the side of the rear end 24. In fact, the first footwear element 15 has material continuity between the inner sole assembly 16 and the lateral quarter 17, the material continuity forming the lateral border 28. By analogy, the first footwear element 15 has material continuity between the inner sole assembly 16 and the medial quarter 18, the material continuity forming the medial border 29. The lateral edge 26 and medial edge 27 are transversely opposite one another, and the lateral border 28 and medial border 29 are also transversely opposite one another. It is to be understood that the lateral edge 26 and the lateral border 28 extend one another along the longitudinal direction L, that is, the direction the lateral edge 26 extends rearwardly, from the front end 25 to its intersection with edge 41 of the lateral quarter 17, extends along the lateral border 28 (i.e., along the material continuity that forms the lateral border 28), i.e., the lateral edge 26 and the lateral border 28 are co-extensive. Similarly, the medial edge 27 and the medial border 29 extend one another, i.e., they are co-extensive, along the longitudinal direction L. This means that the lateral edge 26 and lateral border 28 are a continuation of one another, and that the medial edge 27 and the medial border 29 are a continuation of one another, respectively.

To further facilitate the description of the pattern 20, four specific zones 31, 32, 33, 34 of the inner sole assembly 16 are defined. Thus, from its rear end 24 to its front end 25, the inner sole assembly 16 has four successive zones. These zones include a rear end zone 31, or heel zone, structured and arranged to support the heel of the foot; a first intermediate zone 32, structured and arranged to support the arch of the foot; a second intermediate zone 33, structured and arranged to support the metatarsus; and a front end zone 34 or tip zone, structured and arranged to support the toes.

To form the pattern 20, or the footwear element 15, the lateral quarter 17 transversely extends the inner sole assembly 16 in a direction extending away from the lateral border 28, the lateral border 28 extending along the first intermediate zone 32 of the inner sole assembly 16. Similarly, the medial quarter 18 transversely extends the inner sole assembly 16 in a direction extending away from the medial border 29, the border 29 extending along the first intermediate zone 32 of the inner sole assembly 16.

Each of the quarters 17, 18 also extends forwardly. Thus, the lateral quarter 17 has a front convex lower edge 41 structured and arranged to be affixed to the lateral edge 26 of the sole assembly 16. The lower edge 41 begins at the junction of the lateral edge 26 and the lateral border 28. Consequently, the pattern 20 has a lateral front notch 42 which widens out toward the front 5, between the lateral edge 26 and lower edge 41. Similarly, the medial quarter 18 has a front convex lower edge 43 adapted to be affixed to the medial edge 27 of the sole assembly 16. The lower edge 43 begins at the junction of the medial edge 27 and the medial border 29. Consequently, the pattern 20 has a medial front notch 44, which widens out toward the front 5, between the medial edge 27 and lower edge 43.

Toward the rear, the lateral quarter 17 has a concave rear edge 51 structured and arranged to demarcate, at least partially, a foot insertion opening. The rear edge 51 begins at the junction of the rear end 24 and the lateral border 28. The rear end 24 and the rear edge 51 extend one another, i.e., they are co-extensive. Similarly, the medial quarter 18 has a concave rear edge 53 structured and arranged to demarcate, at least partially, a foot insertion opening. The rear edge 53 begins at the junction of the rear end 24 and the medial border 29. The rear end 24 and the rear edge 53 extend one another, i.e., they are co-extensive. Thus, the end 24 projects along the longitudinal direction L at the rear 4 of the pattern 20.

To describe the entire perimeter of the pattern 20, the lateral quarter 17 has an upper edge 55, which connects the lower edge 41 to the rear edge 51. Similarly, the medial quarter 18 has an upper edge 56, which connects the lower edge 43 to the rear edge 53. Each of the upper edges 55, 56 extends along the longitudinal direction L, in the areas of the first intermediate zone 32, the second intermediate zone 33, and the front zone 34.

In a non-limiting manner, as can be understood with reference to FIG. 3, the pattern 20 has a thickness e which can be constant or variable. This means that the footwear element 15 has, over at least 80% of its extent, a thickness e ranging between 0.8 and 10 mm, and that values ranging between 1.5 to 4 mm yield good results and are within the scope of the invention. According to the particular embodiment being described, the thickness e is chosen to be constant. According to the first embodiment being described, the footwear element 15 includes two superposed layers 59, 60. For example, the first layer 59 is a structural layer or envelope structured and arranged to be affixed to the outer sole assembly 2 and to demarcate the exterior of the upper 3, as is further described below. The second layer 60 is a lining structured and arranged to contact the foot and, consequently, demarcates the interior of the upper 3.

The first layer 59 and the second 60 layer are assembled against one another, for example with glue or adhesive, and form a laminated material. The thickness of the envelope 59 is equal to or greater than the thickness of the lining 60.

It is to be understood that the number of layers of the footwear element is not limited, and that there may be two or more.

In a non-limiting manner, the envelope 59 is structured and arranged to provide the footwear element 15 with mechanical strength. In other words, the footwear element 15 has a self-sustaining structure, which is uniform in its mechanical properties, such as tensile strength, and/or the like. The envelope 59 is for example made of ethyl-vinyl acetate (EVA), polyurethane, or any equivalent. The lining 60, which can be made of a fabric, or any equivalent, provides a certain comfort for the wearer.

Figure 4:
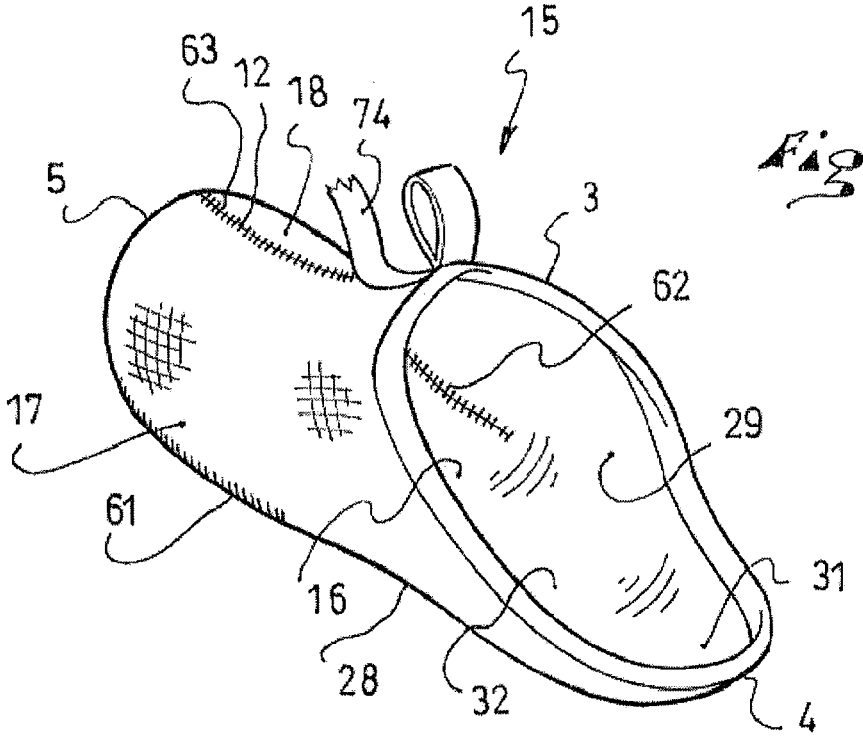
FIG. 4 is a perspective top rear view of the footwear element made from the pattern of FIG. 2.
Figure 5:
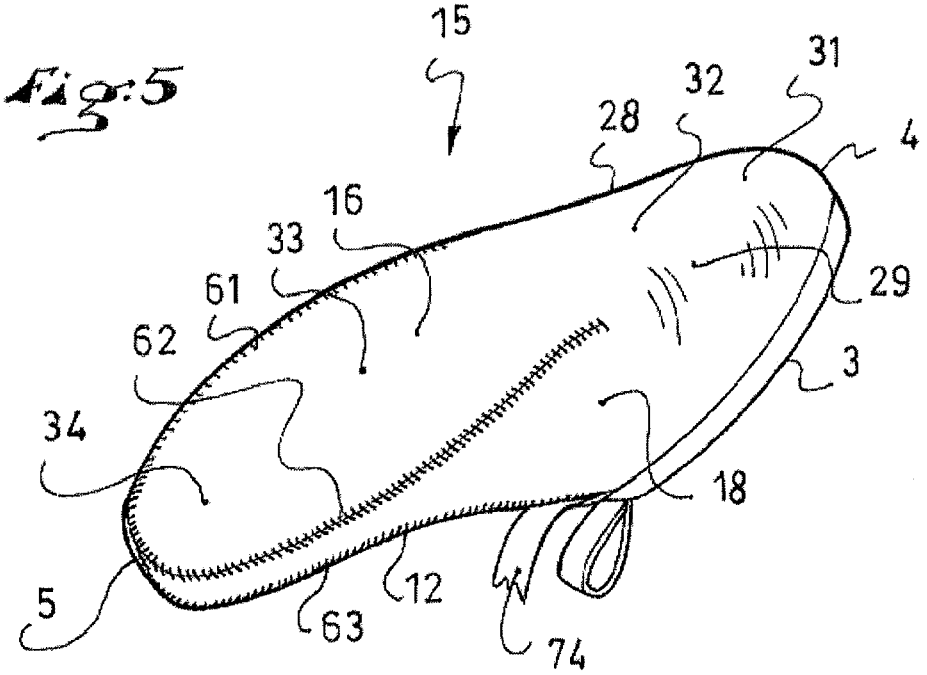
FIG. 5 is a perspective bottom front view, on the side of the inner sole assembly, of the footwear element of FIG. 4.

The architecture of the aforementioned pattern 20 makes it possible to construct the footwear element 15, shown particularly in FIGS. 4 and 5. In these figures, the two-dimensional pattern 20 produces the three-dimensional footwear element 15. This means that a flat element has been changed into a three-dimensional object.

The lateral quarter 17 extends forward from the lateral border 28, a permanent attachment expedient 61 connecting the lateral quarter 17 to the inner sole assembly 16 forward of the lateral border 28. In addition, the medial quarter 18 extends forward from the medial border 29, a permanent attachment expedient 62 connecting the medial quarter 18 to the sole assembly 16 forward of the medial border 29. Finally, a permanent attachment expedient 63 connecting the lateral quarter 17 to the medial quarter 18 in the area of the top portion 12 of the upper 3, i.e., also in the area of the top portion 12 of the footwear element 15. The footwear element 15 thus formed has the general appearance of a slipper. Consequently, the shoe 1 also has the appearance of a slipper. The shoe, or slipper, is very comfortable because it has material continuity beneath the arch of the foot and transversely on both sides of the arch. This continuity is effective in the area of the first intermediate zone 32.

According to the first embodiment of the invention, the three attachment expedients 61, 62, 63 mentioned hereinabove are stitches. These expedients are common in the art of shoemaking and they are relatively easy to implement. But other expedients are also within the scope of the invention, such as attachments created by gluing, welding, and/or the like. In general, embodiments of the invention can be created in which one or more attachment expedients 61, 62, 63 are stitches, i.e., stitching.

In a non-limiting manner, each length of stitching 61, 62, 63 connects and retains two of the three subdivisions 16, 17, 18 of the first footwear element 15 relative to one another by butt-joining, i.e., joining edge to edge. More specifically, the front lower edge 41 of the lateral quarter 17 abuts the lateral edge 26 of the inner sole assembly 16; the front lower edge 43 of the medial quarter 18 abuts the medial border 27 of the inner sole assembly 16; and the upper edge 55 of the lateral quarter 17 abuts the upper edge 56 of the medial quarter 18. This is the arrangement that provides the footwear element 15, and therefore the upper 3, with the best uniform curvature in the area in which there is no material continuity. As a result, the envelopment of the foot and comfort are optimized. Nothing, however, prevents superposing a quarter 17, 18 with the inner sole assembly 16, or the quarters with one another. Indeed, the material continuity, and the comfort deriving therefrom, remains in the area of the arch of the foot.

The junction between the lateral quarter 17 and medial quarter 18, in the area of the top portion 12 of the upper 3, is oriented along the longitudinal direction L. Consequently, the means 63 for attaching the quarters 17, 18, i.e., the stitching 63 in this case, is oriented along the longitudinal direction L. This is because the upper edges 55, 56 of the pattern 20 are oriented along the longitudinal direction L. This facilitates the manufacture of the pattern, and also its shaping, to obtain the footwear element 15.

Figure 6:
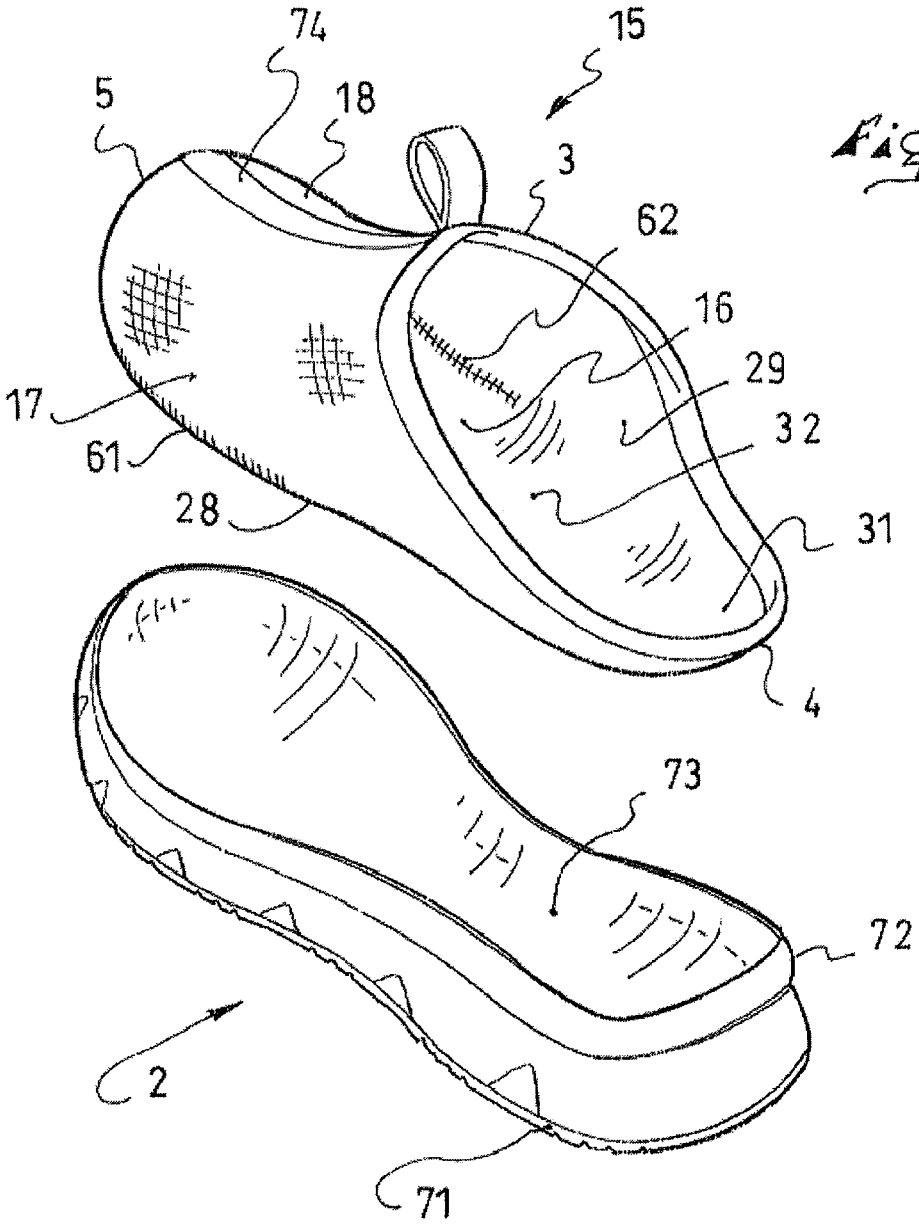
FIG. 6 is a perspective top rear view of the footwear element and of the outer sole assembly, prior to assembly to one another to form the shoe according to FIG. 1.

To make the shoe 1, as can be understood with reference to FIG. 6, the footwear element 15 is affixed to the outer sole assembly 2. In a non-limiting manner, the outer sole assembly 2 includes an outsole 71, structured and arranged to contact the ground, and a midsole 72, positioned between the outsole 71 and the footwear element 15. The outsole 71 comprises of one or more abrasion-resistant materials, such as rubber. The midsole 72 is a cushioning layer comprising, for example, one or more materials adapted to absorb impacts. In a non-limiting manner, the midsole is constructed in this case of ethyl-vinyl-acetate, known by the acronym EVA, or any similar material, such as polyurethane or the like. Depthwise, the sole assembly 2 therefore extends from the outsole 71 to an attachment surface 73, which is demarcated by the top of the midsole 72. The shoe 1 is made by affixing the footwear element 15 to the attachment surface 73, for example by gluing. The surface 73 has an undulating, non-planar shape in order to better adapt to the upper and to the sole of the foot. This avoids the need to use an additional inner sole assembly.

In a non-limiting manner, the attachment is made so that the expedients 61, 62 for permanent connection of the lateral 17 and medial 18 quarters to the inner sole assembly 16, such as lengths of stitching, are opposite the outer sole assembly 2. This means that the permanent attachment expedients 61, 62 are opposite the attachment surface 73. Consequently, as shown in FIG. 1, these expedients 61, 62 are externally invisible on the finished shoe 1. It can be said that the outer sole assembly 2 covers the permanent attachment expedients 61, 62. This increases the strength of the shoe 1, and makes it more aesthetically appealing.

Further, a band 74 extends along the junction of the lateral 17 and medial 18 quarters, in the area at the top portion 12 of the upper 3. The band 74 covers the attachment expedient 63, i.e., such as the length of stitching 63, which also increases the strength of the shoe 1, and makes it more aesthetically appealing. A primarily, or purely, decorative band could alternatively be provided, which would then partially, if at all, cover the junction of the quarters.

The shoe 1 thus constructed is both lightweight and comfortable.

Other embodiments of the invention are described below with reference to FIGS. 7 to 13. For reasons of convenience, the elements shared with the first embodiment are designated by the same reference numerals.

Figure 7:
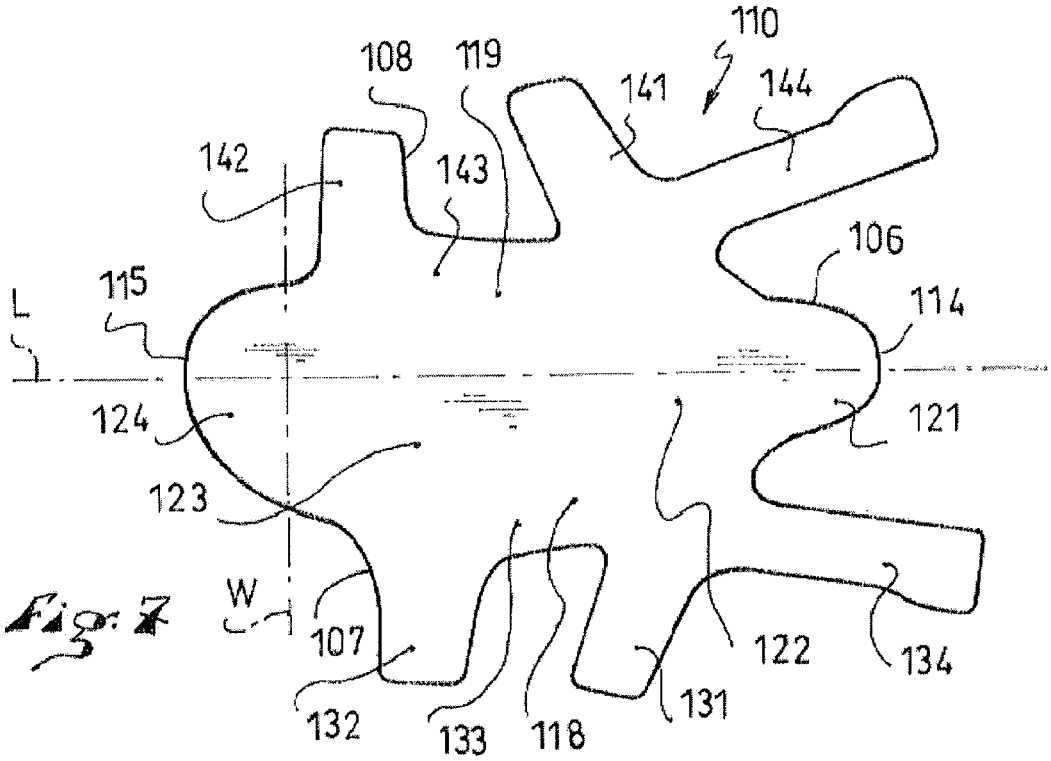
FIG. 7 is a view of a flat pattern, constructed and arranged for the manufacture of a footwear element of a shoe according to a second embodiment of the invention.
Figure 8:
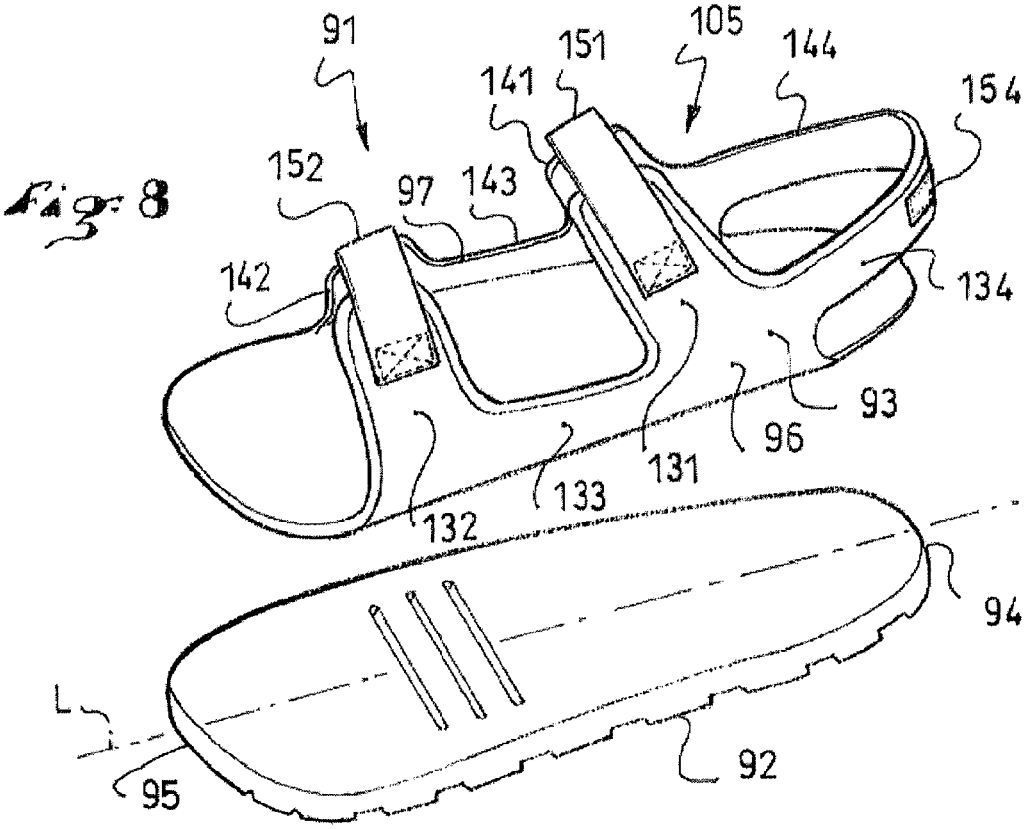
FIG. 8 is a perspective top front view of a footwear element, made from the pattern of FIG. 7, and that of an outer sole assembly.

A second embodiment is described with reference to FIGS. 7 and 8. In particular, this embodiment is a shoe 91 that includes an outer sole assembly 92 and an upper 93. The shoe 91 extends along a longitudinal direction L, from a heel 94 to a tip 95, and along a transverse direction W, between a lateral side 96 and a medial side 97. The shoe 91 includes a footwear element 105 with an inner sole assembly 106, a lateral quarter 107, and a medial quarter 108. Here, as with the previously described embodiment, the inner sole assembly 106 is arranged between the lateral quarter 107 and the medial quarter 108, these three elements being affixed by material continuity according to a pattern 110.

The inner sole assembly 106 extends lengthwise, from a rear end 114 to a front end 115, and widthwise between a lateral border 118 and a medial border 119. The inner sole assembly 106 has a rear zone 121, a first intermediate zone 122, a second intermediate zone 123, and a front zone 124.

The second embodiment of the invention is specific in that the lateral quarter 107 is connected to the inner sole assembly 106 only by material continuity, and that the medial quarter 108 is connected to the inner sole assembly 106 only by material continuity. This simplifies the manufacture of the footwear element 105. In a non-limiting manner, the lateral quarter 107, and therefore also the lateral border 118, extends in the area of the first intermediate zone 122 and the second intermediate zone 123. Similarly, the medial quarter 108, and also the medial border 119, extends in the first 122 and second 123 intermediate zones. This means that a lateral material continuity 118 extends in the area of the first and second intermediate zones 122, 123 and that a medial material continuity 119 extends in the area of the first 122 and second 123 intermediate zones. Therefore, the shoe 91 envelops the foot transversely, with great precision and comfort. The material continuity enables the footwear element 105 to closely fit the arch of the foot and the transverse portions of the foot.

The lateral quarter 107, for example, includes a rear transverse extension 131 and a front transverse extension 132 connected to one another by a bridge 133, as well as a rear arm 134 extending from the rear transverse extension 131. Similarly, the medial quarter 108, for example, includes a rear transverse extension 141 and a front transverse extension 142 connected to one another by a bridge 143, as well as a rear arm 144 extending from the rear transverse extension 141.

To provide the footwear element 105 with its three-dimensional shape, the shoe 91 includes a means 151 for affixing the rear transverse extensions 131, 141 to one another, an arrangement 152 for affixing the front transverse extensions 132, 142 to one another, and an arrangement 154 for affixing the rear arms 134, 144 to one another. Each of these arrangements 151, 152, 154, as needed, may be a permanent attachment expedient or, alternatively, a removable attachment expedient. The shoe 91 thus constructed is a sandal.

Figure 9:
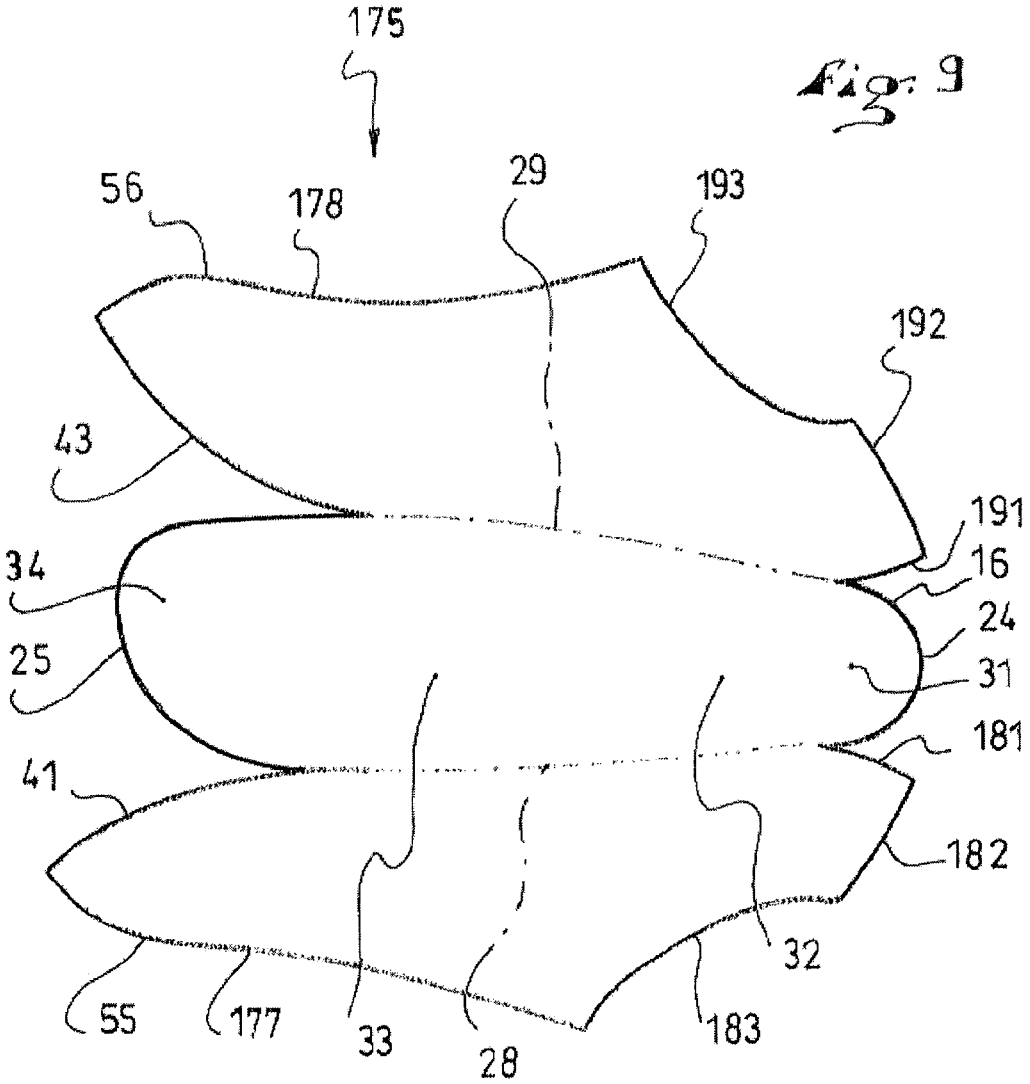
FIG. 9 is a view of a flat pattern, provided for a footwear element according to a third embodiment of the invention.

The third embodiment of the invention is next described with reference to FIGS. 9 to 11. Due to their similarity, the third embodiment has a number of elements in common with the first embodiment. Thus, FIG. 9 shows a footwear element 175 which includes an inner sole assembly 16, a lateral quarter 177, and a medial quarter 178. The inner sole assembly 16 has a rear end 24 and a front end 25. The lateral quarter 177 has a front lower edge 41 and an upper edge 55. The medial quarter 178 has a front lower edge 43 and an upper edge 56. A lateral border 28, between the inner sole assembly 16 and the lateral quarter 177, extends in the area of the first intermediate zone 32 and the second intermediate zone 33. A medial border 29, between the inner sole assembly 16 and the medial quarter 178, extends in the area of the first intermediate zone 32 and the second intermediate zone 33.

A specific characteristic of the third embodiment is in the organization of the rear portion of the shoe.

Thus, the lateral quarter 177, from the border 28 to the upper edge 55, has a lower convex rear edge 181, an intermediate straight rear edge 182, and a concave leading edge 183. Similarly, the medial quarter 178, from the border 29 to the upper edge 56, has a lower convex rear edge 191, an intermediate straight rear edge 192, and a concave inlet edge 193.

Consequently, after the footwear element 175 has been configured into three dimensions, as shown in FIGS. 10 and 11, the lateral quarter 177 extends rearward of the lateral border 28; a permanent attachment expedient 201, such as a length of stitching, connects the lateral quarter 177 to the inner sole assembly 16 at the rear of the lateral border 28; the medial quarter 178 extends rearward of the medial border 29; a permanent attachment expedient 202, such as another length of stitching, connecting the medial quarter 178 to the inner sole assembly 16 at the rear the medial border 29; and a permanent attachment expedient 203, such as another length of stitching, connects the lateral quarter 177 to the medial quarter 178 in the area of the rear end 4 of the shoe.

In a non-limiting manner, as with the first embodiment, each of the permanent attachment expedients 201, 202, 203 includes a length of stitching. More specifically, each expedient 201, 202, 203 is a length of stitching. Here again, in this exemplary embodiment, a simple, easy-to-implement technique is used. The footwear obtained, has the general appearance of a shoe, which is provided with an outer sole assembly.

According to the third embodiment, the expedients 201, 202 for the permanent attaching of the lateral and medial quarters 177, 178 to the inner sole assembly 16 are opposite the outer sole assembly 2. The attachment expedients 201, 202 are therefore hidden from the outside when the shoe is assembled, for a better appearance.

The junction between the lateral quarter 177 and the medial quarter 178, in the area of the rear end 4, is contained in a longitudinal plane perpendicular to the outer sole assembly 2. This facilitates the affixing of the quarters 177, 178 to one another. A band, not shown, is also provided to extend over the junction of the lateral quarter 177 and the medial quarter 178, in the area of the rear end 4. The appearance of the shoe is made only better.

Figure 12:
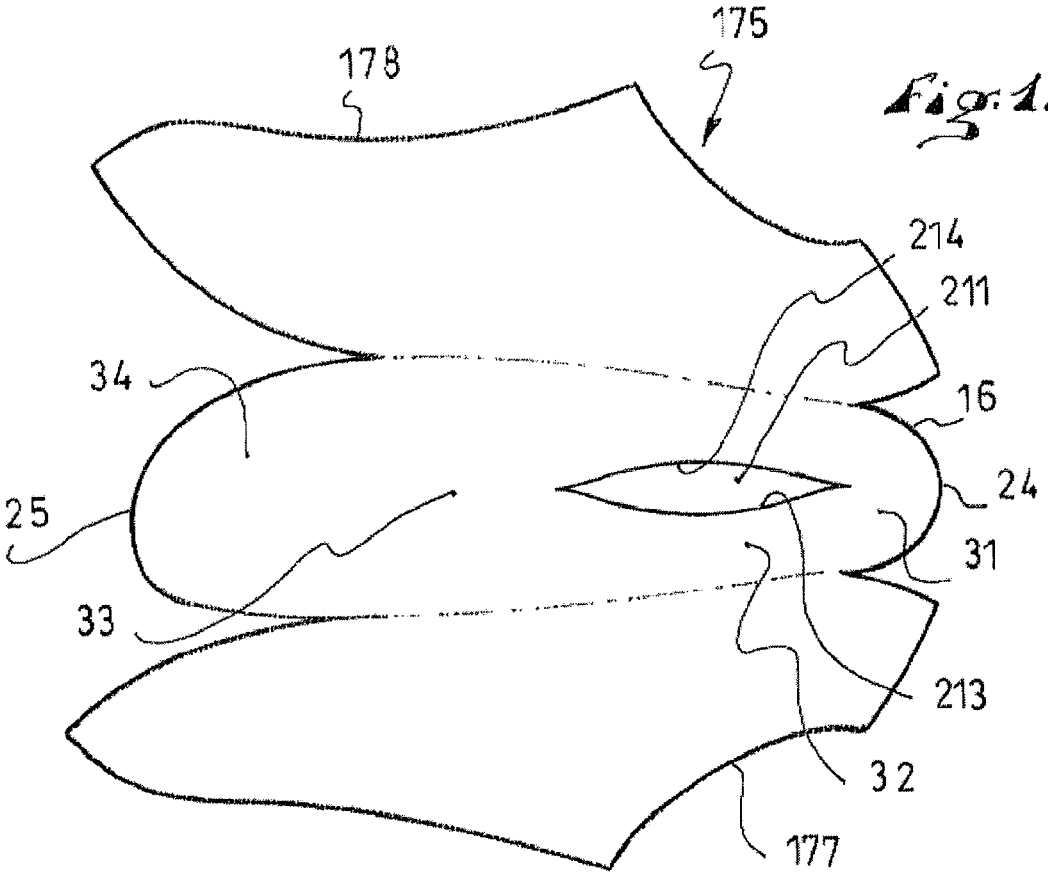
FIG. 12 is similar to FIG. 9, according to a fourth embodiment of the invention.
Figure 13:
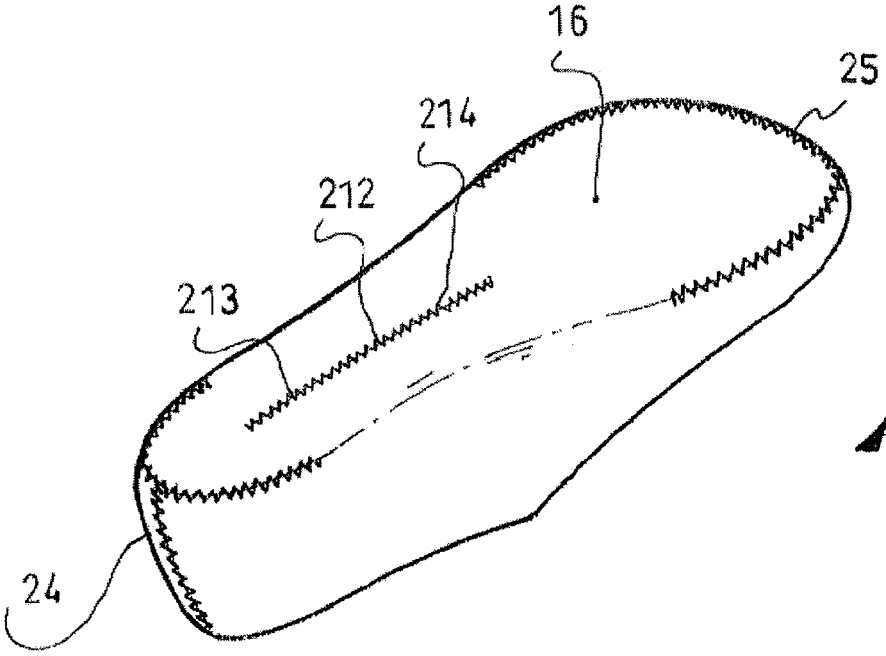
FIG. 13 is similar to FIG. 11, for the fourth embodiment of the invention.

The fourth embodiment is next described with reference to FIGS. 12 and 13. This embodiment is identical to the third embodiment, except for one detail. Thus, the fourth embodiment has a pattern that makes it possible to obtain the footwear element 175 with an inner sole assembly 16 and its quarters 177, 178.

The fourth embodiment is specific in that the inner sole assembly 16 has an elongated cutout 211, and that a permanent attachment expedient 212 connects the two edges 213, 214 of the cutout to one another. Here, the cutout 211 is provided in the first intermediate zone 32 and oriented along the longitudinal direction L. The cutout 211 has a leaf-shape with pointed ends, and is demarcated only by the two edges 213, 214. The permanent attachment expedient 212 is a length of stitching. The stitching retains the two edges 213, 214 of the cutout 211 relative to one another in a butt-joint. This arrangement reduces the width of the footwear element in the area of the arch of the foot, or even the heel. In fact, the localized narrowing of the footwear element makes it possible to adapt the shoe to a narrower foot. The surface evenness of the inner sole assembly 16 is preserved for optimal foot comfort.

Figure 14:
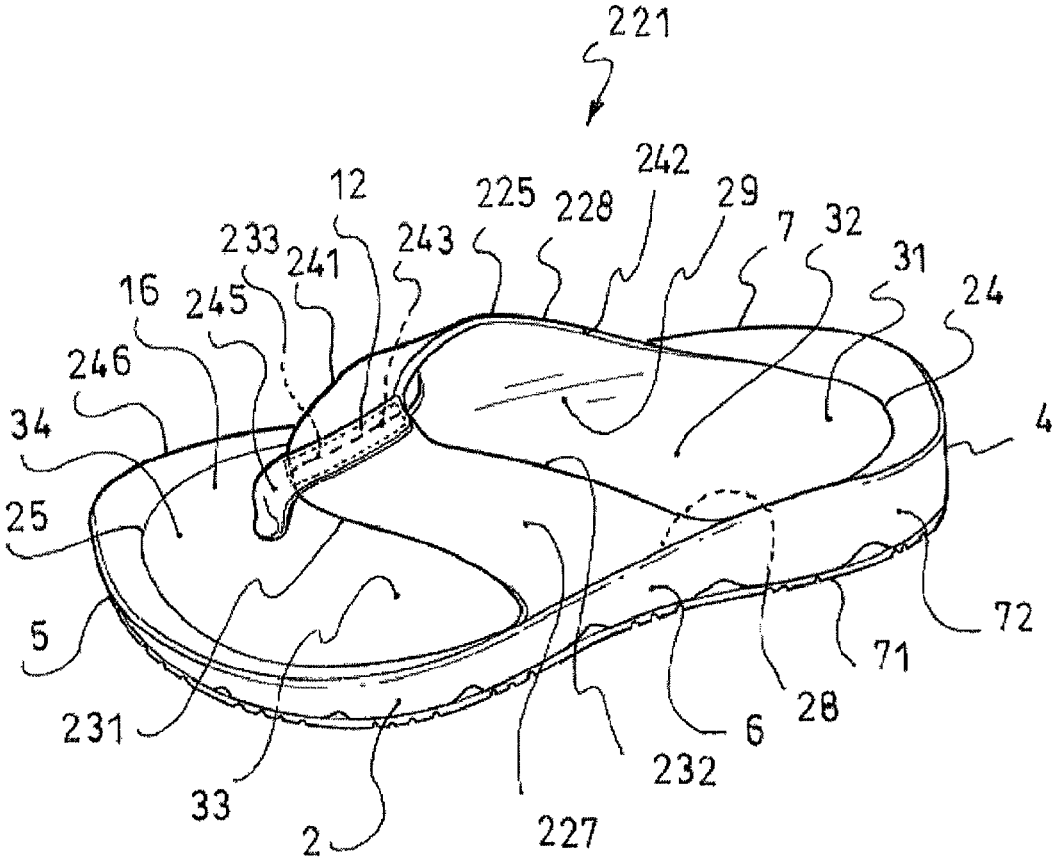
FIG. 14 is a perspective top and side view, according to a fifth embodiment of the invention.

The fifth embodiment is next described with reference to FIG. 14. Due to their similarity, the fifth embodiment has a number of elements in common with the first embodiment. Thus, this embodiment is a shoe 221 which includes an outer sole assembly 2, with an outsole 71 and a midsole 72, as well as a footwear element 225, with an inner sole assembly 16, a lateral quarter 227, and a medial quarter 228. As with the previous embodiments, the outer sole assembly 2 extends lengthwise, from the rear end 4 to the front end 5, and widthwise, between the lateral side 6 and the medial side 7. The inner sole assembly 16 extends lengthwise, from the rear end 24 to the front end 25, and widthwise, between the lateral border 28 and the medial border 29.

The fifth embodiment is specific in that the shoe 221 has the general appearance of a thong shoe, or flip-flop. Thus, the lateral quarter 227 has a front edge 231, a rear edge 232, and an upper edge 233. Similarly, the medial quarter 228 has a front edge 241, a rear edge 242, and an upper edge 243. Each of the quarters 227, 228 extends from the inner sole assembly 16, in the area of the first intermediate zone 32. The upper edges 233, 243 of the quarters 227, 228 are affixed to one another in the area of the top portion 12. A fastener 245 extends from the top portion 12 to the inner sole assembly 16. The fastener 245 includes for example a band, made of fabric or any equivalent, or a linkage of other structure. In a particular embodiment, the fastener 245 is provided to be inserted between the big toe and the second toe. Thus, the quarters 227, 228 and the fastener 245 form the double straps that are characteristic of a thong. In addition, the inner sole assembly 16 has a reduced surface area compared to that of the outer sole assembly 2, and the latter, around the inner sole assembly 16, has a raised peripheral edge 246 which surrounds the base of the foot. This ensures a better foot support, and falls within the meaning of material continuity between the inner sole assembly 16 and the quarters 227, 228.

The invention is constructed from materials and by means of techniques of implementation known to a person of ordinary skill in the art.

The invention is not limited to the particular embodiments described above, and includes all technical equivalents that fall within the scope of the claims that follow.

For example, other shapes may be provided to make a footwear element.

The lining of the footwear element can extend over only a portion of the envelope.

An article of footwear, or shoe, according to the invention has a transverse material continuity in the area of the arch of the foot, i.e., within the first intermediate zone.

In addition, the invention illustratively disclosed herein suitably may be practiced in the absence of any element which is not specifically disclosed herein.

The invention claimed is:

1. An article of footwear comprising:

an outer sole assembly, including a ground-contacting outsole;

an upper;

a length extending from a rear end to a front end;

a width extending from a lateral side to a medial side;

a height extending from the outer sole assembly to a top portion;

a first footwear element permanently affixed to the outer sole assembly, the first footwear element comprising:

an inner sole assembly configured to contact a sole of a wearer's foot;

a lateral quarter; and a medial quarter;

the inner sole assembly, the lateral quarter, and the medial quarter of the first footwear element form a unitary element;

the first footwear element having material continuity between the inner sole assembly and at least one of either the lateral quarter and the medial quarter, the material continuity forming at least one of either a lateral border and a medial border of the inner sole assembly;

the lateral quarter extending forward of the lateral border, a permanent attachment expedient connecting the lateral quarter to the inner sole assembly forward of the lateral border;

the medial quarter extending forward of the medial border, a permanent attachment expedient connecting the medial quarter to the inner sole assembly forward of the medial border;

a permanent attachment expedient connecting the lateral quarter to the medial quarter in the area of a top portion of the upper;

the outer sole assembly covering the permanent attachment expedients between the inner sole assembly and, respectively, the lateral and medial quarters;

the permanent attachment expedients between the inner sole assembly and, respectively, the lateral and medial quarters not being visible externally on the article of footwear.

2. An article of footwear according to claim 1, wherein:

the first footwear element has material continuity between the inner sole assembly and the lateral quarter, the material continuity forming a lateral border;

the first footwear element has material continuity between the inner sole assembly and the medial quarter, the material continuity forming a medial border.

3. An article of footwear according to claim 2, wherein:

the lateral border extends along a first intermediate zone of the inner sole assembly; and the medial border extends along the first intermediate zone of the inner sole assembly sole.

4. An article of footwear according to claim 1, wherein:

the lateral quarter extends rearward of the lateral border, a permanent attachment expedient connecting the lateral quarter to the inner sole assembly rearward of the lateral border;

the medial quarter extends rearward of the medial border, a permanent attachment expedient connecting the medial quarter to the inner sole assembly rearward of the medial border;

a permanent attachment expedient connects the lateral quarter to the medial quarter in the area of the rear end.

5. An article of footwear according to claim 1, wherein:

the permanent attachment expedient, connecting each of the lateral quarters and medial quarters to the inner sole assembly, are opposite the outer sole assembly.

6. An article of footwear according to claim 1, wherein:

a junction between the lateral quarter and the medial quarter, in the area of the top portion of the upper, is oriented along the length.

7. An article of footwear according to claim 1, wherein:

a band extends over a junction of the lateral quarter and medial quarter, in the area of the top portion of the upper.

8. An article of footwear according to claim 4, wherein:

a junction between the lateral quarter and the medial quarter, in the area of the rear end, is contained in a longitudinal plane perpendicular to the outer sole assembly.

9. An article of footwear according to claim 4, wherein:

a band extends over a junction of the lateral quarter and medial quarter, in the area of the rear end.

10. An article of footwear according to claim 1, wherein:

one or more of the permanent attachment expedients are lengths of stitching.

11. An article of footwear according to claim 10, wherein:

each of the lengths of stitching retains two subdivisions of the first footwear element relative to one another at a butt joint.

12. An article of footwear according to claim 1, wherein:

the inner sole assembly has an elongated cutout;

a permanent attachment expedient connects the two edges of the cutout to one another.

13. An article of footwear according to claim 12, wherein:

the permanent attachment expedient connecting the two edges of the cutout is stitching.

14. An article of footwear according to claim 13, wherein:

the stitching retains the two edges of the cutout relative to one another at a butt joint.

15. An article of footwear according to claim 1, wherein:

the footwear element includes two superposed layers;

a first of the superposed layers being a structural layer; and a second of the superposed layers being a lining.

16. An article of footwear according to claim 1, wherein:

the outer sole assembly comprises an attachment surface attached to the inner sole assembly of the first footwear element;

the attachment surface of the outer sole assembly comprises a wearer's sole-conforming shape, said shape being, undulating and non-planar.

17. An article of footwear according to claim 16, further comprising:

glue permanently affixing the inner sole assembly of the first footwear element to the attachment surface of the outer sole assembly.

18. An article of footwear according to claim 10, wherein:

none of the one or more lengths of stitching extends into the ground-engaging outsole.

* * * * *